US009587373B2

(12) United States Patent
Gift et al.

(10) Patent No.: US 9,587,373 B2
(45) **Date of Patent: *Mar. 7, 2017**

(54) DUST SUPPRESSION ARRANGEMENT FOR HEAVY EXCAVATION EQUIPMENT

(71) Applicant: Vermeer Manufacturing Company, Pella, IA (US)

(72) Inventors: David William Gift, Pella, IA (US); James Thaddeus Schmidt, Des Moines, IA (US); Mark Cooper, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/605,345

(22) Filed: Jan. 26, 2015

(65) Prior Publication Data

US 2015/0191893 A1 Jul. 9, 2015

Related U.S. Application Data

(63) Continuation of application No. 13/582,779, filed as application No. PCT/US2010/026363 on Mar. 5, 2010, now Pat. No. 8,955,919.

(51) Int. Cl.

| | |
|---|---|
| ***E21C 35/22*** | (2006.01) |
| ***E01C 23/088*** | (2006.01) |
| ***E02F 3/92*** | (2006.01) |

(52) U.S. Cl.

CPC ..... *E02F 3/9212* (2013.01); *E02F 3/9293* (2013.01); *E21C 35/223* (2013.01); *E01C 2301/50* (2013.01)

(58) Field of Classification Search

CPC .... E01C 2301/50; E21C 35/22; E21C 35/223; E21F 5/20

See application file for complete search history.

(56) References Cited

U.S. PATENT DOCUMENTS

| | | | |
|---|---|---|---|
| 2,819,571 | A | 1/1958 | Morgan |
| 3,103,273 | A | 9/1963 | James, Jr. |

(Continued)

FOREIGN PATENT DOCUMENTS

| | | | |
|---|---|---|---|
| EP | 1 288 377 | A1 | 12/2010 |
| JP | 8-302730 | A | 11/1996 |

(Continued)

OTHER PUBLICATIONS

International Search Report for corresponding International Patent Application No. PCT/US2010/026363 mailed Dec. 16, 2010.

(Continued)

*Primary Examiner* — John Kreck
*Assistant Examiner* — Michael Goodwin
(74) *Attorney, Agent, or Firm* — Merchant & Gould P.C.

(57) ABSTRACT

An excavation apparatus is disclosed. The excavation apparatus includes a chassis having a length that extends from a front end to a rear end of the chassis. The chassis also has a width oriented perpendicular to the length. A boom is pivotally attached to the rear end of the chassis. A cutting component mounted to the boom. A shroud structure at least partially covers the cutting component. A source of vacuum is in fluid communication with an interior of the shroud structure for drawing air containing dust from the interior of the shroud structure. A filter filters the air drawn from the interior of the shroud structure by the source of vacuum. A dust barrier projects downwardly from the shroud structure and extends along at least a portion of a perimeter of the shroud structure. The dust barrier has a construction that is pervious to debris generated by the cutting component and that provides gradually reduced restriction to inward air flow through the dust barrier as the dust barrier extends downwardly from the shroud structure.

8 Claims, 10 Drawing Sheets

(56) References Cited

U.S. PATENT DOCUMENTS

| | | | | |
|---|---|---|---|---|
| 3,109,273 | A | 11/1963 | Soldner | |
| 3,186,021 | A | 6/1965 | Krier et al. | |
| 3,213,598 | A | 10/1965 | Olsson | |
| 3,589,111 | A | 6/1971 | Gullickson et al. | |
| 3,646,712 | A | 3/1972 | Quintana | |
| 3,726,562 | A | 4/1973 | Wharton, III | |
| 4,041,623 | A * | 8/1977 | Miller | E01C 19/008 172/4.5 |
| 4,433,032 | A | 2/1984 | Nakamura et al. | |
| 4,561,145 | A | 12/1985 | Latham | |
| 4,697,389 | A | 10/1987 | Romine | |
| 4,727,913 | A | 3/1988 | Bliss | |
| 4,755,001 | A * | 7/1988 | Gilbert | E02F 3/085 299/39.8 |
| 4,932,163 | A | 6/1990 | Chilton et al. | |
| 4,940,289 | A * | 7/1990 | Trovato | B08B 7/022 173/24 |
| 5,063,713 | A * | 11/1991 | Buchheit, Jr. | E01C 23/088 299/39.2 |
| 5,069,723 | A | 12/1991 | Cole, Jr. et al. | |
| 5,092,658 | A | 3/1992 | Smith | |
| 5,125,190 | A | 6/1992 | Buser et al. | |
| 5,161,910 | A | 11/1992 | O'Konek | |
| 5,207,391 | A | 5/1993 | Anderson | |
| 5,291,697 | A | 3/1994 | Nelson | |
| 5,310,122 | A | 5/1994 | McFarlane | |
| 5,319,911 | A | 6/1994 | Wilhite | |
| 5,322,472 | A | 6/1994 | Little | |
| 5,354,146 | A | 10/1994 | O'Konek | |
| 5,373,688 | A | 12/1994 | Stanley et al. | |
| 5,381,646 | A | 1/1995 | Casey et al. | |
| 5,433,032 | A | 7/1995 | Bath et al. | |
| 5,481,983 | A | 1/1996 | Guzman et al. | |
| 5,490,339 | A | 2/1996 | Accettola | |
| 5,490,571 | A | 2/1996 | Hanns et al. | |
| 5,505,390 | A | 4/1996 | Rodgers | |
| 5,545,082 | A | 8/1996 | Courson et al. | |
| 5,645,232 | A | 7/1997 | Staples et al. | |
| 5,860,232 | A | 1/1999 | Nathenson et al. | |
| 5,878,696 | A | 3/1999 | Gerling et al. | |
| 5,908,224 | A * | 6/1999 | Santos | B24B 7/188 125/13.01 |
| 6,503,125 | B1 | 1/2003 | Harrington | |
| 6,619,755 | B1 * | 9/2003 | Christensen | E01C 23/08 299/39.2 |
| 6,733,086 | B1 | 5/2004 | McSharry et al. | |
| 6,916,236 | B2 | 7/2005 | Terpstra | |
| 6,979,261 | B1 | 12/2005 | Day et al. | |
| 6,997,667 | B2 | 2/2006 | Hackett et al. | |
| 7,073,495 | B1 | 7/2006 | Markley | |
| 7,077,601 | B2 | 7/2006 | Lloyd | |
| 7,261,623 | B1 | 8/2007 | Palushi | |
| 7,409,743 | B2 | 8/2008 | Di Anna | |
| 7,704,128 | B1 | 4/2010 | Staples et al. | |
| 8,061,344 | B2 | 11/2011 | Dofher | |
| 8,262,168 | B2 | 9/2012 | Hall et al. | |
| 2002/0012572 | A1 * | 1/2002 | Bruso | A01B 33/021 405/128.1 |
| 2002/0043059 | A1 | 4/2002 | Konzak et al. | |
| 2002/0193056 | A1 * | 12/2002 | Nielsen | A47L 9/102 451/350 |
| 2005/0127741 | A1 | 6/2005 | Davey et al. | |
| 2007/0023328 | A1 | 2/2007 | Flora et al. | |
| 2007/0096539 | A1 * | 5/2007 | Walker | E01C 23/0933 299/39.3 |
| 2007/0125558 | A1 | 6/2007 | Embry | |
| 2007/0155285 | A1 | 7/2007 | Padgett et al. | |
| 2007/0207711 | A1 | 9/2007 | Crocker | |
| 2008/0060631 | A1 | 3/2008 | Dofher | |
| 2008/0282584 | A1 | 11/2008 | Hall et al. | |

FOREIGN PATENT DOCUMENTS

| | | |
|---|---|---|
| JP | 2004-182146 A | 7/2004 |
| JP | 2008-031745 A | 2/2008 |

OTHER PUBLICATIONS

Photos of prior art dust collection system taken in Oct. 2009, 3 pgs.
www.constructionequipment.com, The Drill Construction Equipment, "Vacuum Excavation" 2 pgs, Jul. 27, 2008.
www.vermeer.com, Construction Equipment, Farm Machinery and Trenching and Trenchless Equipment, 5 pgs, Jul. 27, 2008.

* cited by examiner

DUST SUPPRESSION ARRANGEMENT FOR HEAVY EXCAVATION EQUIPMENT

This application is a Continuation of U.S. patent application Ser. No. 13/582,779, filed on Nov. 13, 2012, which is a National Stage Stage Application of PCT/US2010/026363, filed Mar. 5, 2010 and which applications are incorporated herein by reference. A claim of priority is made to each of the above disclosed applications.

TECHNICAL FIELD

The present disclosure relates generally to dust suppression equipment.

BACKGROUND

Heavy off-road excavation equipment such as terrain levelers, trenchers, rock wheels and vibratory plows are used to excavate geologic material. For example, trenchers, vibratory plows and rock wheels are often used to excavate trenches into geologic material such as soil or rock. Terrain levelers are commonly used to unearth or loosen relatively wide stretches of geologic material. For example, terrain levelers can be used for mining applications to loosen a layer of soil within the mine (e.g., an open strip or pit mine) before the material is removed by another piece of equipment such as front end loader. Particularly in dry conditions, such heavy excavation equipment can generate large amounts of dust.

SUMMARY

The present disclosure relates generally to a dust suppression arrangement adapted to suppress the amount of dust that a piece of heavy off-road excavation equipment discharges to atmosphere during excavation operations. In one embodiment, the dust suppression arrangement is adapted for use on a terrain leveler. The dust suppression arrangement is also applicable to other type of excavation equipment such as trenchers, rock wheels and vibratory plows.

These and other features and advantages will be apparent from reading the following detailed description and reviewing the associated drawings. It is to be understood that both the foregoing general description and the following detailed description are explanatory only and are not restrictive of the broad aspects of the disclosure.

DETAILED DESCRIPTION

Figure 1:
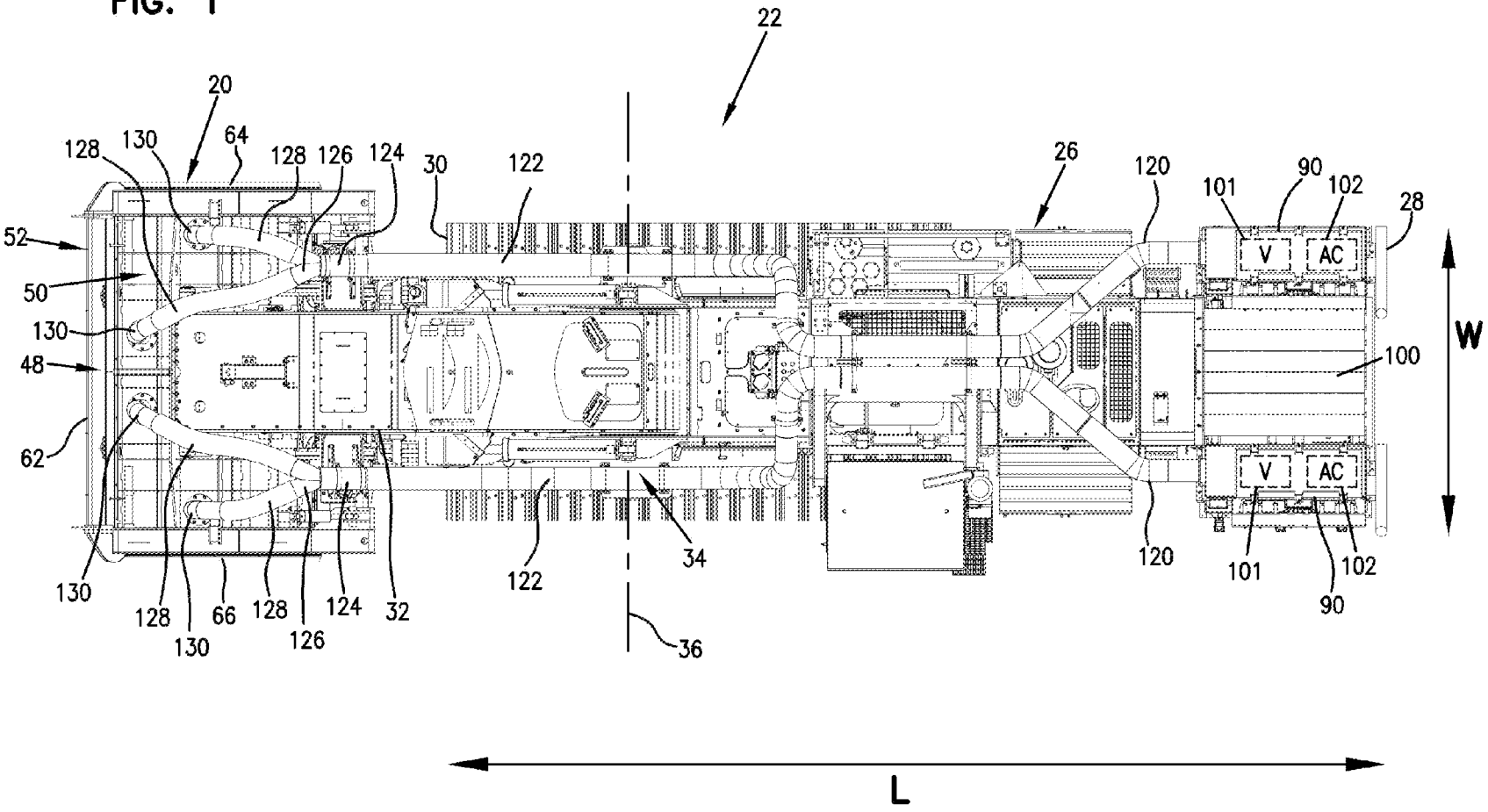
FIG. 1 is a top view of an excavation apparatus having a dust suppression arrangement in accordance with the principles of the present disclosure.
Figure 2:
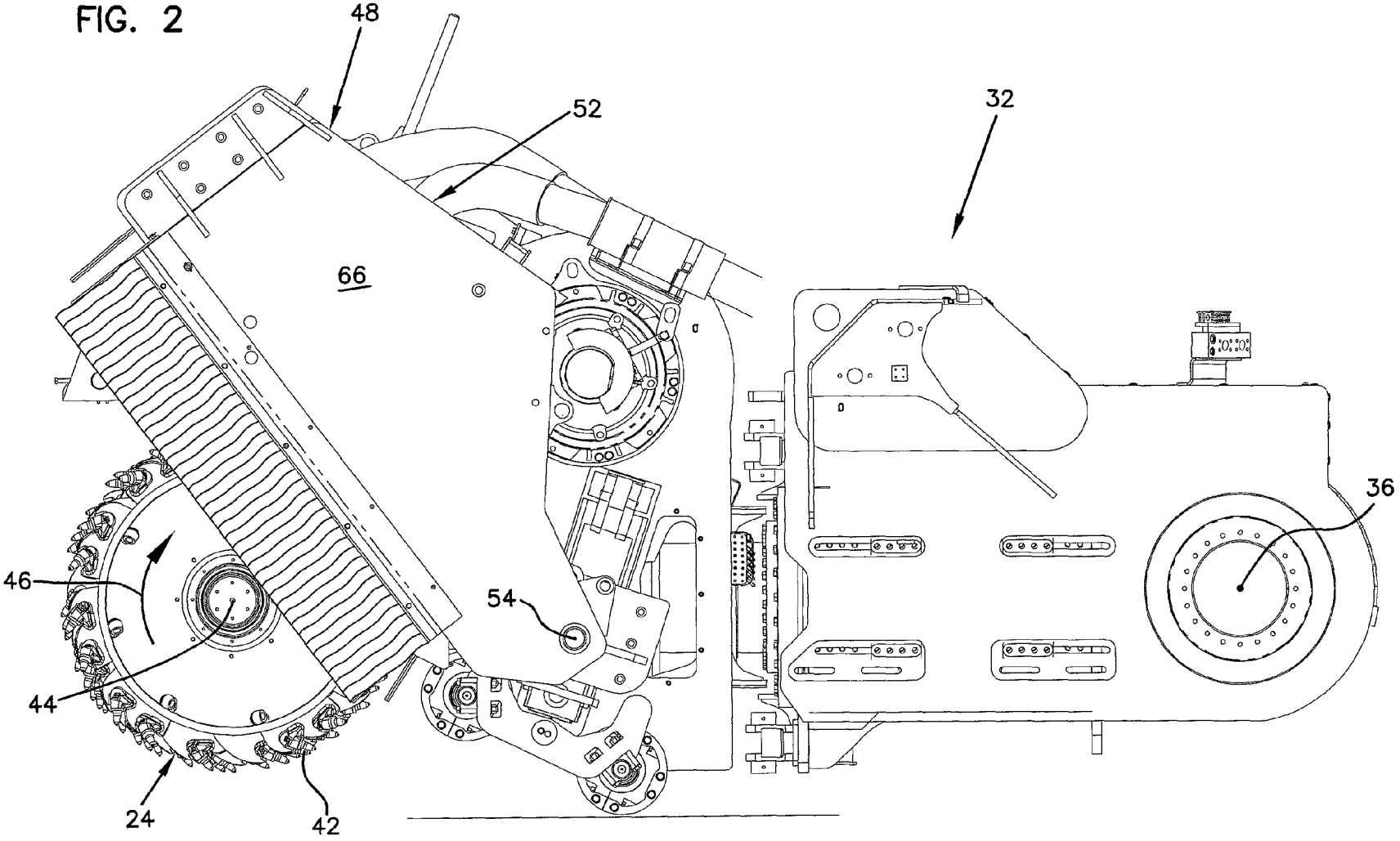
FIG. 2 is a side view of a boom of the excavation apparatus of FIG. 1 with a boom of the excavation apparatus in a non-excavating orientation and a pivotal shroud component of the dust suppression arrangement in a raised orientation.

The present disclosure relates generally to dust suppression arrangement for use on heavy equipment such as an off-road excavation apparatus FIG. 1 shows an example dust suppression arrangement 20 mounted on a piece of off-road excavation equipment in the form of a terrain leveler 22. During excavation operations using the terrain leveler 22, the dust suppression arrangement 20 captures dust generated by a cutting drum 24 (see FIG. 2) of the terrain leveler 20 thereby reducing the amount of dust that is emitted/discharged to atmosphere.

Referring still to FIG. 1, the terrain leveler 22 includes a chassis 26 having a front end 28, positioned opposite from a rear end 30. The chassis 26 has a length L and a width W. A boom 32 is attached to the rear end 30 of the chassis 26 at a pivot location 34 that allows the boom to be raised and lowered relative to the chassis 26. For example, the pivot location 34 can define a pivot axis 36 about which the boom 32 can be pivoted between an upper, non-excavating orientation (shown at FIGS. 2 and 3) and a lower/excavating position (see FIG. 4). The boom 32 projects rearwardly from the rear end 30 of the chassis 26.

The cutting drum 24 is rotatably mounted at a rear, free end of the boom 32. The cutting drum 24 includes a generally cylindrical cutting face to which a plurality of cutting teeth 42 are attached. During excavation, the boom 32 is moved to the excavating position of FIG. 4 while the cutting drum 24 is concurrently rotated about a central axis 44 of the cutting drum. The central axis extends across the width W of the chassis 26. In certain embodiments, the cutting drum 24 can be rotated about the central axis 44 by a drive arrangement such as a continuous chain that is driven by a drive such as hydraulic drive. The chain extends around a central region of the cutting drum 24 such that rotation of the chain causes rotation of the cutting drum 24. In a preferred embodiment, the chain and the cutting drum 24 are rotated in a direction 46 about the central axis 44 during excavation operations. The cutting drum 24 has a length that extends across at least a majority of the width of the chassis 26. While the drawings show the cutting teeth facing forwardly at the bottom of the drum, in actual practice, it is preferred for the teeth to face rearwardly at the bottom of the drum to complement rotation in the direction 46.

The dust suppression arrangement 20 mounted on the terrain leveler 22 includes a shroud assembly 48 that is carried by the boom 32. The shroud assembly 48 includes a fixed shroud component 50 secured to the boom 32 at a location directly over the cutting drum 24. The fixed shroud component 50 has a length that extends generally along the entire length of the cutting drum 24. One or more sources of vacuum create negative pressure (i.e., pressure below atmospheric pressure) that continuously draws dust laden air from within an interior of the shroud assembly and carries the dust laden air to an air cleaning arrangement. Vacuum generated negative pressure within the shroud causes outside air to be drawn inwardly into the shroud from a perimeter of the shroud thereby preventing dust generated by the cutting drum 24 from escaping from the perimeter of the shroud assembly 48. Dust within the air drawn from the shroud assembly 48 via vacuum is removed from the air by the air cleaning arrangement (e.g., filter arrangements, cyclones, etc.). The sources of vacuum and air cleaning arrangements can be provided within cabinets 90 mounted to the chassis 26.

Figure 3:
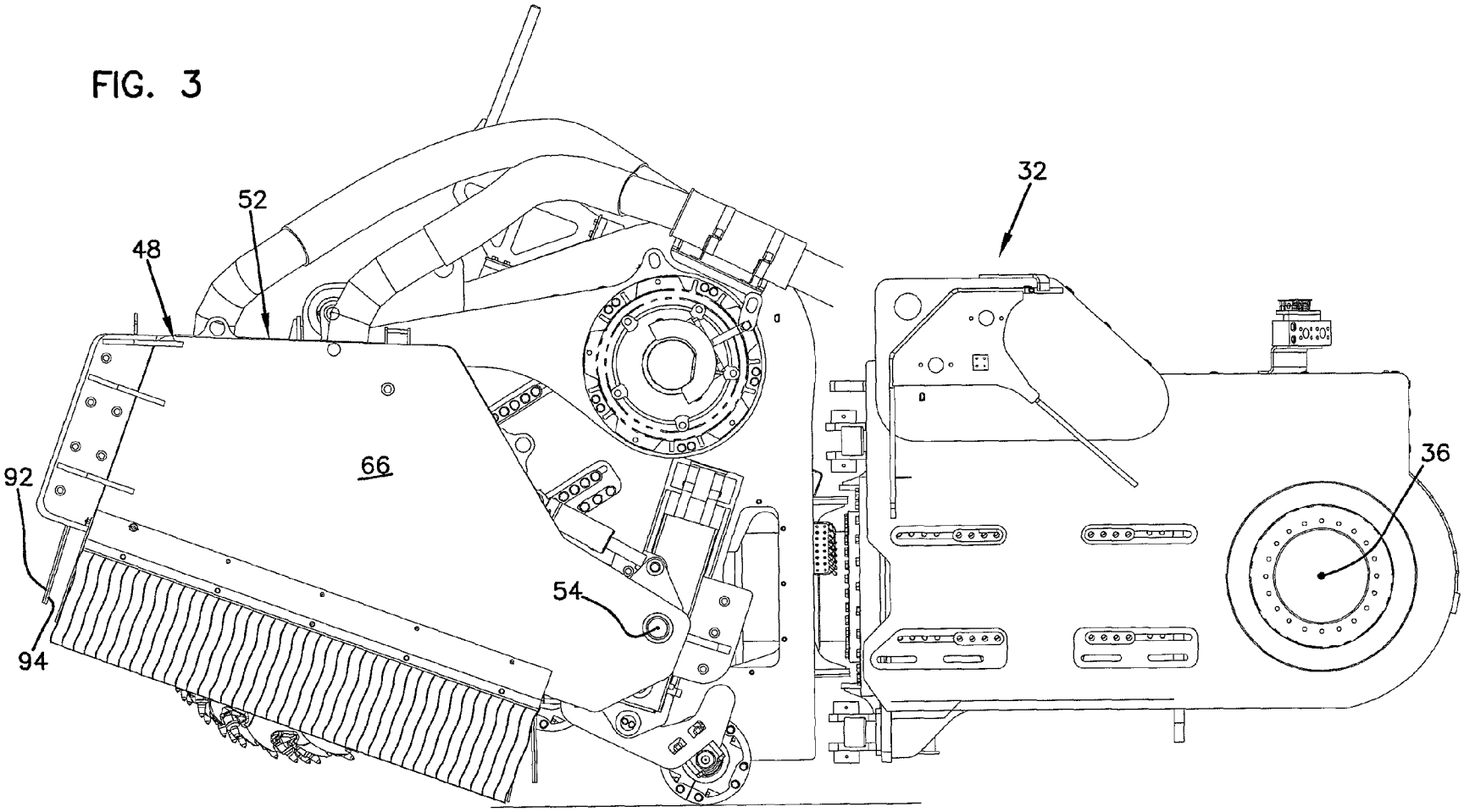
FIG. 3 illustrates the boom of FIG. 2 with the pivotal shroud component in an intermediate position.
Figure 4:
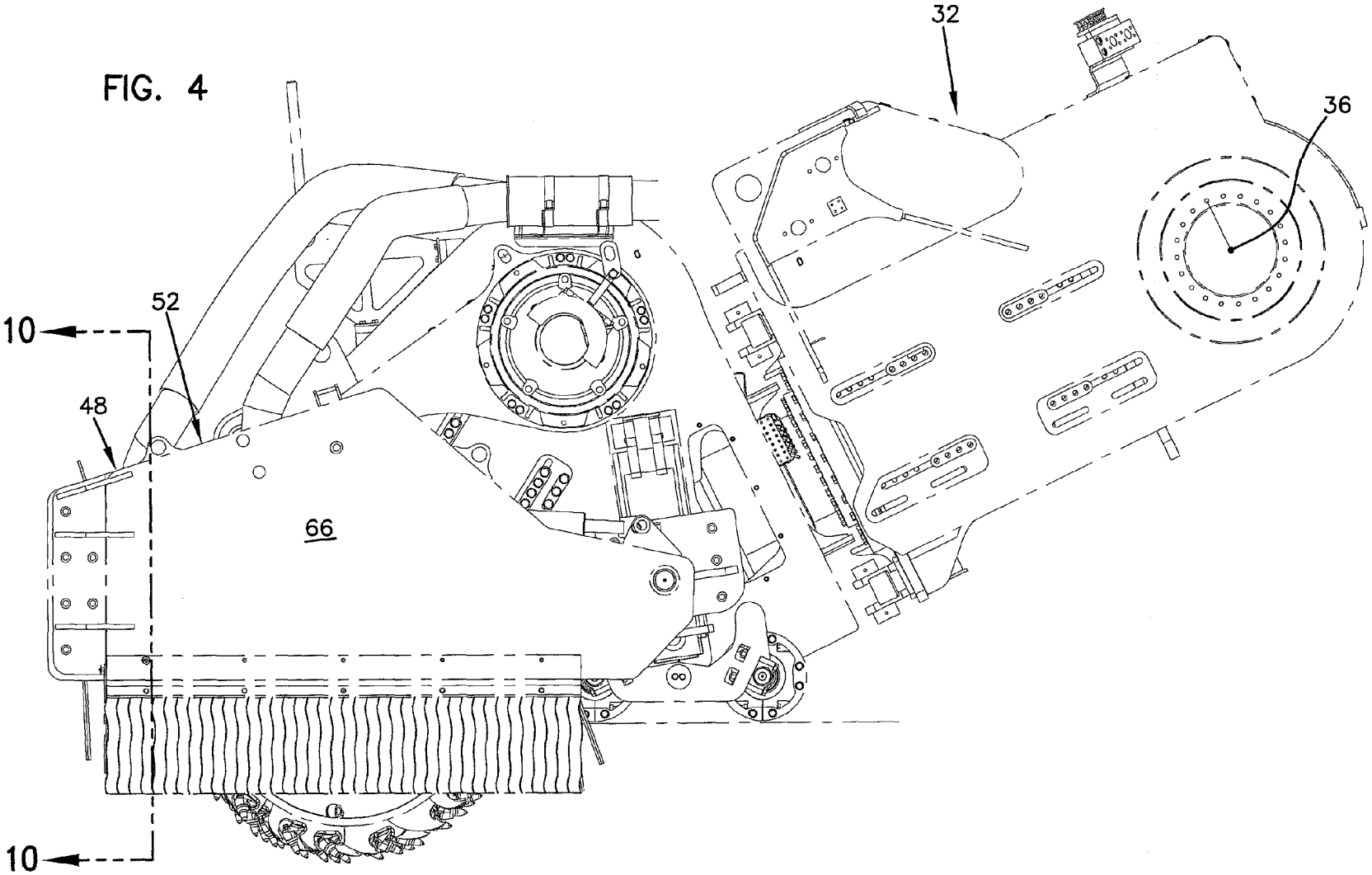
FIG. 4 shows the boom of FIG. 2 in a lowered, excavating orientation with the pivotal shroud component in a lowered, dust suppression orientation.

The shroud assembly 48 also includes a movable shroud component 52 that is pivotally movable relative to the boom 32. The movable shroud component 52 can be pivoted about a pivot axis 54 between various positions. For example, the movable shroud component 52 can be moved to a raised position (shown at FIG. 2), and a lowered, dust suppression position (shown at FIGS. 3 and 4). The pivot axis 54 is generally parallel to the central axis 44 of the cutting drum 24. It is preferred for the fixed shroud component 50 and the movable shroud component 52 to have a generally rigid, robust construction. In certain embodiments, such a rigid, robust construction can be provided by materials such as reinforced sheet metal. While the position of FIGS. 3 and 4 is described as the "dust suppression position", it will be appreciated that the dust suppression system can also be used to suppress dust with the moveable shroud component 52 in an intermediate position between the position of FIGS. 3 and 4 and the position of FIG. 2. The depth of cut and type of material being excavated may dictate the most suitable position of the moveable shroud component 52 to provide dust suppression.

Figure 7:
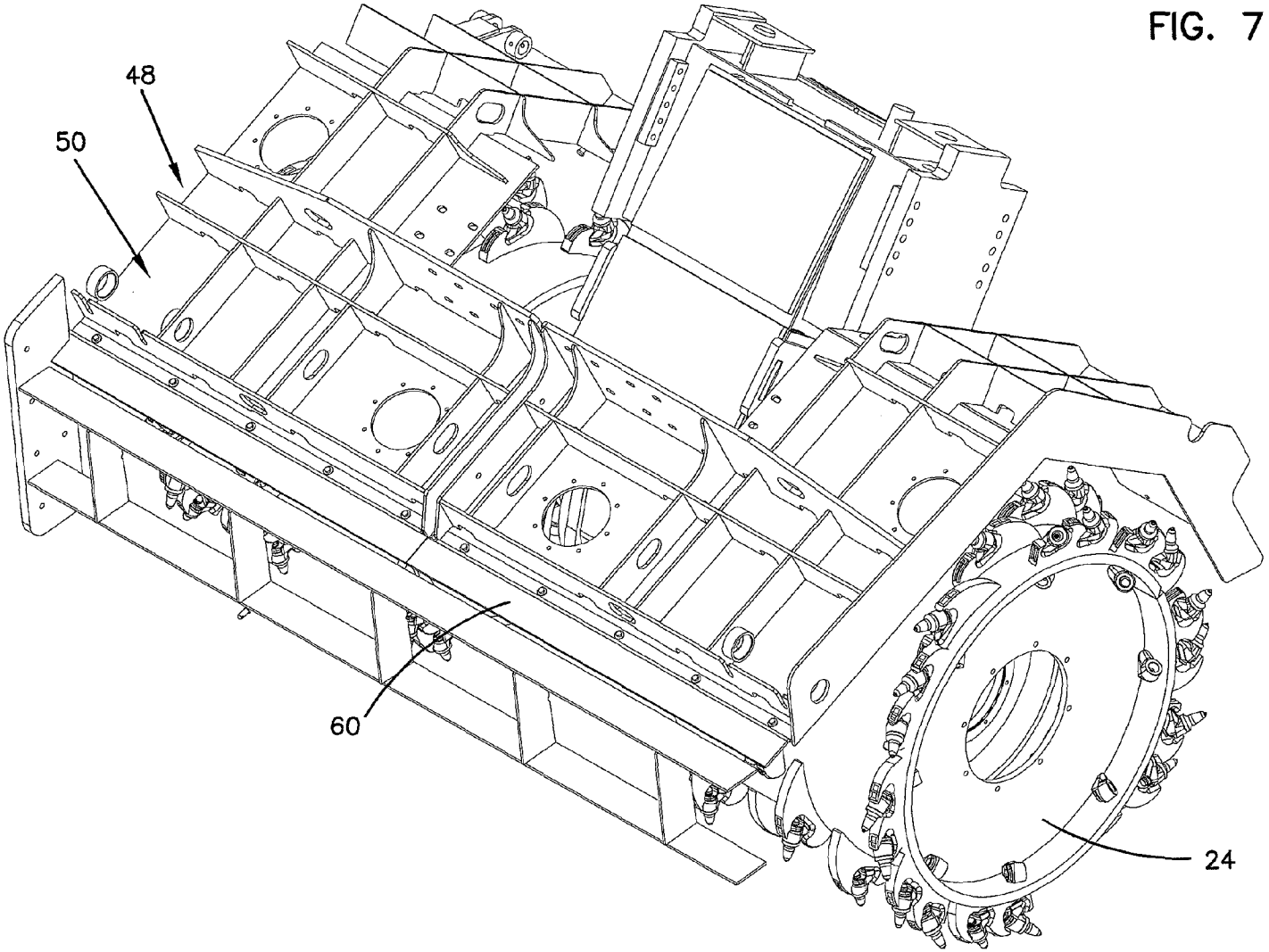
FIG. 7 is a rear, top perspective of a fixed shroud component of the dust suppression arrangement provided on the excavation apparatus of FIG. 1.

The dust suppression arrangement 20 can also include a sealing structure 91 (see FIG. 10) provided between the fixed shroud component 50 and the movable shroud component 52. For example, a sealing structure in the form a brush 60 is shown mounted to a rear edge of the fixed shroud component 50 (see FIG. 7). The brush extends along substantially the entire length of the fixed shroud component 50 and is positioned to engage the movable shroud component 52 at least when the movable shroud component 52 is in the lowered, dust suppression position of FIG. 4.

Figure 8:
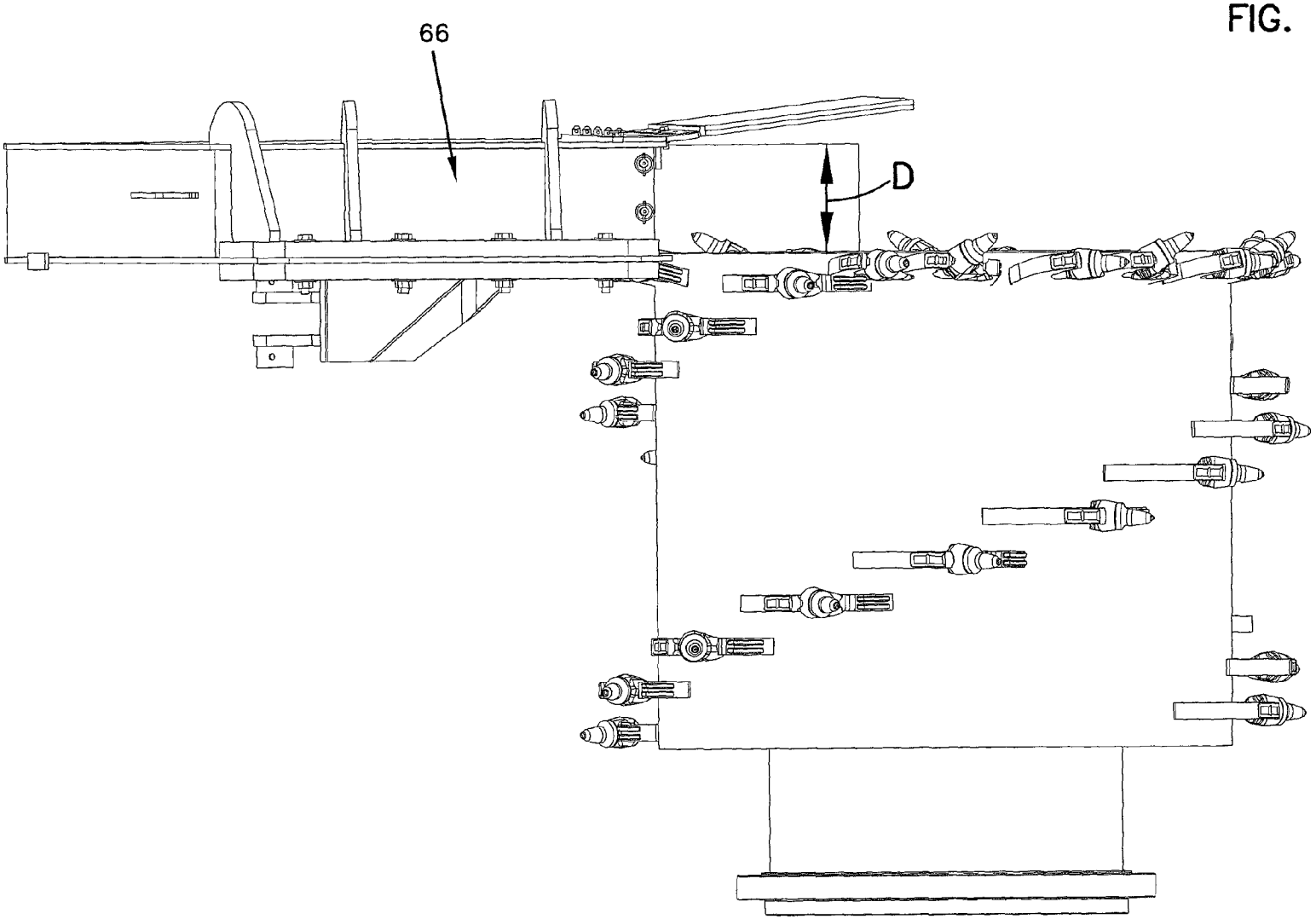
FIG. 8 a top view of a side piece of the pivotal shroud component of FIG. 2 shown in a raised elevation relative to cutting drum.

The movable shroud component 52 includes a rear portion 62 that extends across the width of the terrain leveler 22 and is generally parallel to the cutting drum 24. The rear portion 62 is engaged by the brush 60 when the movable shroud component 52 is in the lowered, dust suppression position of FIG. 4. When the movable shroud component 52 is in the lowered position of FIG. 4, the rear portion 62 is positioned rearwardly of the cutting drum 24. The movable shroud component 52 also includes side portions 64 and 66 that project forwardly from the rear portion 62 and that straddle the cutting drum 24 and the fixed shroud component 50. The side portions 60 are pivotally connected to the boom 32 at the pivot axis 54. The side portions 66 oppose and are outwardly offset from corresponding ends of the cutting drum 24. Preferably, the side portions 66 are offset a distance D (see FIG. 8) from the ends of the cutting drum 24. The distance D provides a vacuum air plenum adjacent to each end of the cutting drum 24. The vacuum air plenums are preferably large enough to allow dust to readily be drawn by the vacuum source through the vacuum air plenums. In one embodiment, the distance D is at least 12 inches.

Figure 5:
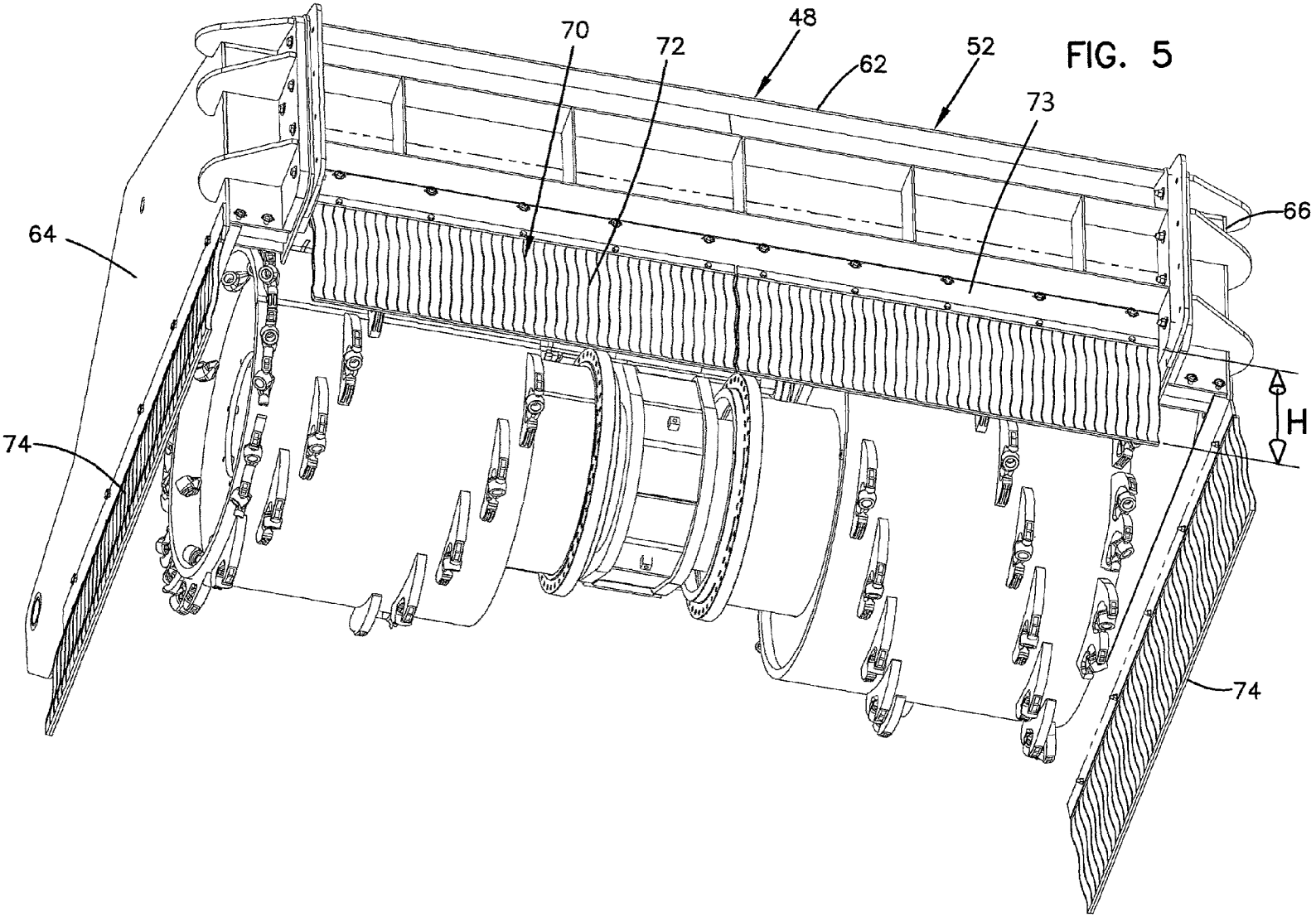
FIG. 5 is a bottom, rear perspective view of the pivotal shroud component of the dust suppression arrangement provided on the excavation apparatus of FIG. 1.

Referring to FIG. 5, the dust suppression arrangement 20 also includes a dust barrier arrangement 70 that extends around at least a major portion of a perimeter of the shroud assembly 48. As shown at FIG. 5, the dust barrier arrangement 70 includes a rear dust barrier 72 mounted to a lower region of the rear portion 62 of the movable shroud component 52. The rear dust barrier 72 preferably extends along a majority of the length of the cutting drum 24 and is generally parallel to the central axis 44 of the cutting drum 24. The dust barrier arrangement 70 also includes side dust barriers 74 connected to lower regions of the side portions 64, 66. When the movable shroud component 52 is in the lowered orientation of FIG. 4, the side dust barriers 74 preferably angle outwardly from the ends of the cutting drum 24 (see FIG. 8) as the side dust barriers 74 extend in a downward direction from the side portions 66 of the movable shroud component 52. The rear dust barrier 72 has a free lower end and an upper end. The upper end of the rear dust barrier 72 is attached to a resilient member 73 (e.g., a sheet of rubber or like material) that is attached to the rear portion 62 of the movable shroud component 52. The resilient member 73 is configured to allow the rear dust barrier 72 to more readily move (e.g., pivot or flex) in a front-to-back orientation relative to the rear portion 62 of the movable shroud component 52. Thus, the resilient member provides a resilient/flexible mount defining a flex/pivot location positioned at the shroud for allowing the entire rear dust barrier 72, including the upper end, to move forwardly and rearwardly relative to the shroud assembly 48 during excavation operations.

Figure 10:
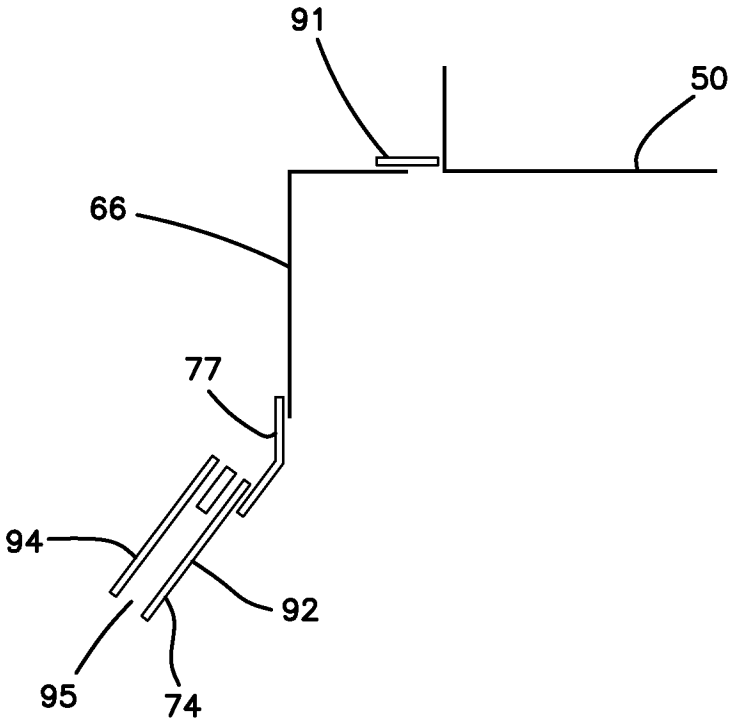
FIG. 10 is a cross-sectional view taken along section line 10-10 of FIG. 4.

The side dust barriers 74 have upper ends connected to the side portions 64, 66 of the movable shroud component 52 and lower free ends. As shown at FIG. 10, the upper ends of the side dust barriers 74 can be connected to the side portions 64, 66 of the movable shroud component 52 via intermediate structures such as angled brackets 77. The angled brackets include upper and lower portions aligned at oblique angles relative to one another. The upper portions attach to side portions 64, 66 of the movable shroud component 52 and the upper ends of the side dust barriers 74 attach to the lower portions of the angled brackets 77. The angled brackets 77 are configured to orient the side dust barriers 74 such that the side dust barriers 74 angle laterally outwardly from the side portions 64, 66 as the side dust barriers extend downwardly from the side portions 64, 66.

Figure 6:
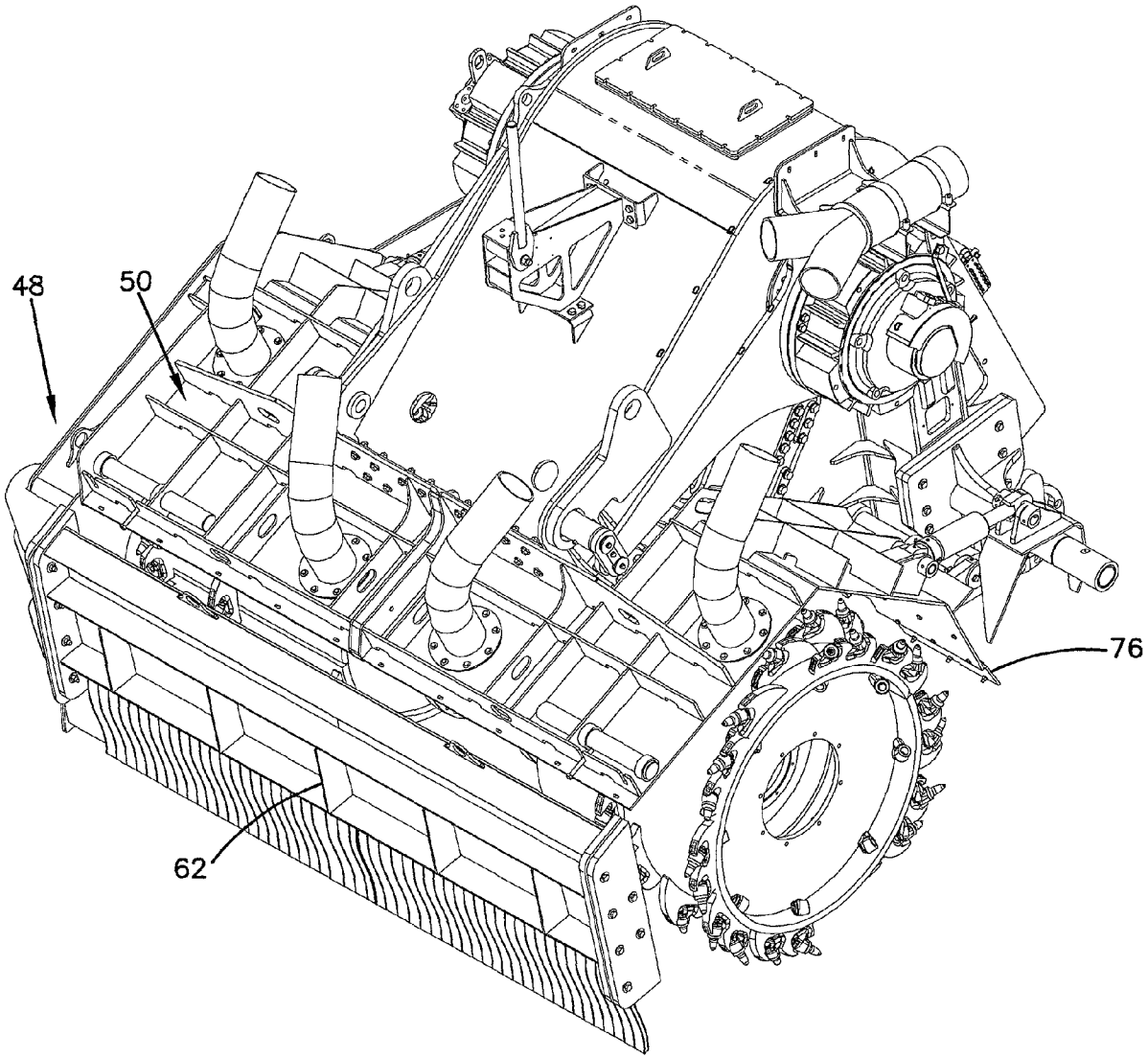
FIG. 6 is a rear, top perspective view of the dust suppression arrangement provided on the excavation apparatus of FIG. 1, a side portion of the pivotal shroud component has been removed to expose a cutting drum otherwise covered by the pivotal shroud component.

The dust barrier arrangement 70 can also include front dust barriers 76 (see FIG. 6) that extend downwardly from a front edge of the fixed shroud component 50. In the depicted embodiment, the front dust barrier 76 are positioned only adjacent to end portions of the cutting drum 24 and no dust barriers are provided in front of a central region of the cutting drum 24. In other embodiments, the front dust barrier 76 can extend along the entire length of the cutting drum 24 with a central portion of the front dust barrier 76 passing under the drive chain of the cutting drum 24.

Figure 9:
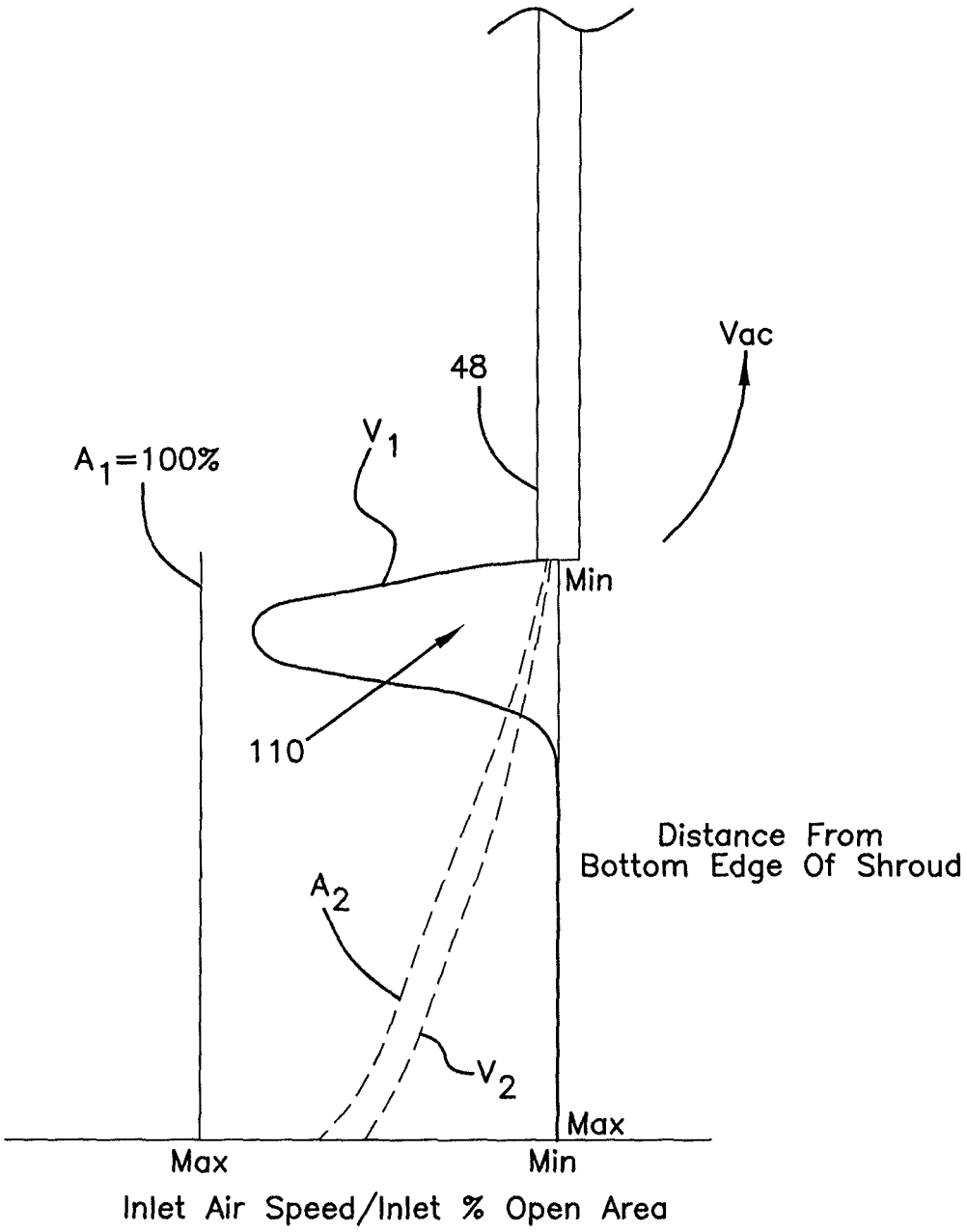
FIG. 9 is a schematic view showing air inlet flow at a perimeter of the shroud assembly.

In a preferred embodiment, the dust barriers extend from the shroud assembly 48 downwardly to a location near the ground when the movable shroud component 52 is in the lowered, dust suppression position and the boom 32 is in the excavating position of FIG. 4. In a preferred embodiment, the dust barriers have a configuration that allows air to flow inwardly through the dust barriers as negative pressure is applied to the interior of the shroud assembly 48. In a preferred embodiment, the dust barriers are more restrictive to air flow adjacent the shroud assembly 48 than adjacent the ground. For example, by using dust barriers in the form of brushes including bristles having secured ends secured together proximate the shroud assembly 48 and free ends spaced from the shroud assembly 48, the bristles provide more resistance to flow through the dust barrier adjacent the shroud assembly 48 as compared to adjacent the ground. This is advantageous because absent the dust barrier, when negative pressure is applied to the interior of the shroud assembly 48, the inlet air flow drawn into the interior of the shroud assembly 48 through the perimeter of the shroud assembly 48 is concentrated at a location close to the shroud assembly 48 and is not distributed across the gap between the shroud assembly 48 and the ground. This is demonstrated schematically by the air flow velocity graph shown at FIG. 9. When a fully open gap (e.g., 100 percent open area A1) is provided between the shroud assembly 48 and the ground, the vast majority of the outside air drawn into the interior of the shroud by vacuum flows through a high flow region 110. The high flow region 110 is limited to a space within a few inches of the bottom of the shroud assembly 48. For example, the air velocity curve V1 shows high air velocities at the localized high flow region 110 and air velocities of zero or about zero for the remainder of the gap between the bottom of the shroud and the ground. By using a dust barrier that provides gradually reduced resistance to pass-through air flow as the dust barrier extends downwardly from the shroud, air flow can be more uniformly distributed across the entire gap between the bottom of the shroud and the ground. For example, the dust barrier provides a gradual increase in open area (as shown by curve A2) as the dust barrier extends downwardly thereby providing a more uniform distribution of flow across the entire gap between the shroud and the ground (as shown by velocity curve V2).

It is also significant that the cutting drum 24 moves excavation material beneath the drum 24 in a front to rear direction as the cutting drum is rotated in the direction 46 about the axis 44. As the material/debris is forced rearwardly by the drum, it can impact the rear dust barrier 72. To reduce the likelihood of damaging the dust barrier 72, the rear dust barrier 72 preferably has a construction that allows debris generated by the cutting drum to pass there-through. In other words, the dust barrier is preferably pervious to debris generated by the cutting drum. Brushes, as described above, having upper ends fixed adjacent the shroud assembly and lower free ends are suited for allowing such debris to pass there-through without damaging the bristles. Providing a flexible mount (e.g., resilient member 73) between the upper ends of the bristles and the shroud assembly 48 also helps limit damage to the dust barrier caused by debris.

By distributing the air intake area at the perimeter of the shroud, the ability to capture dust is enhanced. As described above, the distributed area can be accomplished with the use of brushes such as nylon filament brushes. The flexible brushes are tightly packed at the mounting location adjacent the shroud assembly and gradually separated across the length of the brush. This separation creates a distributed opening and therefore creates a dust barrier variable area. The variable area creates an improved air velocity curve that allows for broader dust capture area than a shroud without a variable area. The brushes are also flexible to allow varying depths of the cut on the excavating apparatus. Because the bristles are more tightly packed adjacent the shroud arrangement, less area is available for air to pass through as compared to the adjacent the lower ends of the bristles where the bristles are not tightly packed.

To allow debris to pass through and to also provide a more uniform distribution of air flow through the dust barriers, it is preferred for the dust barriers to have a height H of at least 15 inches, or about 19 inches. In the depicted embodiments, the dust barriers are formed by two parallel rows of bristles. The rows of bristles can include an inner row 92 of bristles having inner sides facing toward the shroud assembly and an outer row 94 of bristles having outer sides facing toward the outside environment. A gap 95 can be provided between the inner and outer rows of bristles. Upper ends of the bristles can be secured to a mounting rail which in turn is secured to an intermediate structure such as a bracket (e.g., bracket 77) or a resilient mount (e.g., resilient member 73). In one embodiment, the bristles can be made of a polymeric material such as Nylon having a density in the range of 0.9-1.4 grams/cubic centimeter, or of about 1.15 grams/cubic centimeter. In certain embodiments, the bristles can each have a diameter in the range of 0.02-0.05 inches, or in the range of 0.025-0.045 inches, or in the range of 0.030-0.040 inches. In certain embodiments, the bristles can be packed at a density of 20-50 bristles per inch, or 25-45 bristles per inch, or 30-40 bristles per inch.

The side dust barriers 74 are angled outwardly from the cutting drum 24 to prevent the side dust barriers from being contacted by the cutting drum during excavation operations. In certain embodiments, side edges of the fixed shroud component 50 can include gaskets 91 that engage the side portions 66 of the movable shroud component 52 to provide a seal between the fixed shroud component 50 and the side portion 66 of the movable shroud component 52.

The dust suppression arrangement 20 also includes two of the vacuum and air cleaning cabinets 90 mounted at a front most end of the chassis 26. The cabinets 90 are separated by a platform 100. Each of the cabinets 90 includes an air cleaning arrangement 102 and a source of vacuum 101. In one embodiment, the source of vacuum 101 corresponding to each cabinet 90 can generate an air flow rate of at least 2500 cubic feet per minute. Rigid vacuum pipes 120 extend from the cabinets 90 along a portion of the length of the chassis 26. Flexible vacuum hoses 122 are connected to the rigid vacuum pipes 120 and extend to further rigid sections 124 providing bifurcation locations 126. The flexible vacuum hoses 122 extend across the pivot axis 36 of the boom 32 to limit movement of the flexible hoses 122 during pivoting of the boom. Separate flexible vacuum hoses 128 are routed from the bifurcation locations 126 to four separate vacuum ports 130 provided on the fixed shroud component 50. The vacuum ports 130 are in fluid communication with the interior of the shroud assembly 48. The flexible vacuum hoses and rigid vacuum pipes cooperate to define vacuum conduits that extend substantially the entire length of the terrain leveler 22 from the shroud assembly 48 to the cabinets 90 located at the front most end of the terrain leveler 22.

In one embodiment, the cutting drum 24 has a length of at least 12 feet and a diameter of 68 inches, the shroud defines an outer perimeter length of about 144 feet when in the dust suppression orientation, and the vacuum and filtration cabinets 90 each provide a vacuum air flow rate of at least 2500 cubic feet per minute. Thus, a vacuum air flow rate of at least 416 cubic feet per minute per each foot of cutting drum is provided to the shroud assembly 48 by the vacuum source. Also, a vacuum air flow rate of at least 113 cubic feet per minute per each linear foot of perimeter of the shroud assembly is provided to the shroud assembly 48 by the vacuum source. The perimeter of the shroud assembly is the combined distance measured along the front side, the rear side, the left side and the right side of the shroud assembly when the shroud assembly is in the dust suppression orientation.

In use of the terrain leveler 22, the boom 32 is lowered to place the drum 24 at a desired cutting depth while the drum is concurrently rotated in the direction 46 about the central axis 44 of the drum 24. The terrain leveler 22 is then moved in a forward direction thereby causing the cutting drum 24 to excavate a layer of material having a width equal to the length of the cutting drum 24. As this excavation takes place, the shroud assembly 48 is positioned in the lower, dust suppression position of FIG. 4 while the cabinets 90 concurrently draw air from within the shroud assembly 48 thereby providing a negative pressure within the shroud assembly 48. The negative pressure provided by the cabinets 90 causes air to be drawn through the lower dust barriers of the dust suppression arrangement to replace the air that is drawn from the interior of the shroud assembly through the vacuum conduits to the cabinets 90. As air is drawn from the shroud assembly and into the vacuum conduits, dust generated by the cutting drum 24 is carried by the air out of the shroud assembly through the vacuum conduits to the cabinets 90. The dust is filtered or otherwise removed from the air stream within the cabinets 90. After having been removed from the air stream, the dust can be collected in a container or deposited on the ground. During excavation, the dust barrier arrangement assists in maintaining generally uniform inlet air flow through the gap between the shroud assembly 48 and the ground and also allows debris to pass through the dust suppression arrangement without damaging the dust suppression arrangement.

What is claimed is:

1. An off-road excavation apparatus comprising:

a chassis having a length that extends from a front end to a rear end of the off-road excavation apparatus, the chassis also having a width oriented perpendicular to the length;

a cutting component carried by the chassis, the cutting component including a drum on which a plurality of teeth are mounted, the drum being configured to rotate about a central axis; and a dust suppression arrangement for reducing the amount of dust emitted by the off-road excavation apparatus during mining operations, the dust suppression arrangement including a vacuum for drawing dust laden air from a region adjacent to the drum, an air cleaner for removing dust from the air drawn from the region adjacent the drum by the vacuum, and a flexible dust barrier extending along at least a portion of the drum, the flexible dust barrier having a construction that is pervious to debris generated by the cutting component, the flexible dust barrier having an upper end and a free lower end configured to extend to a location near a ground surface when the cutting component is in an excavating position, wherein the flexible dust barrier has a height of at least 15 inches between the upper end and the free lower end.

2. The off-road excavation apparatus of claim 1, wherein the dust barrier has a construction that provides a gradually reduced restriction to inward air flow through the dust barrier, the dust barrier extending downwardly such that the dust barrier is more restrictive to air flow at the upper end thereof than at the free end thereof near the ground surface.

3. The off-road excavation apparatus of claim 1, further comprising:

a shroud structure at least partially covering the cutting component, wherein the upper end of the flexible dust barrier is attached to the shroud structure such that the flexible dust barrier extends along a majority of a perimeter of the shroud structure.

4. The off-road excavation apparatus of claim 3, wherein the flexible dust barrier extends along a length of the drum and along ends of the drum.

5. The off-road excavation apparatus of claim 3, wherein the vacuum is in fluid communication with an interior of the shroud structure.

6. The off-road excavation apparatus of claim 1, wherein the flexible dust barrier includes bristles.

7. An off-road excavation apparatus comprising:

a chassis having a length that extends from a front end to a rear end of the off-road excavation apparatus, the chassis also having a width oriented perpendicular to the length;

a cutting component carried by the chassis, the cutting component including a drum on which a plurality of teeth are mounted, the drum being configured to rotate about a central axis; and a dust suppression arrangement for reducing the amount of dust emitted by the off-road excavation apparatus, the dust suppression arrangement including a vacuum for drawing dust laden air from a region adjacent to the drum, an air cleaner for removing dust from the air drawn from the region adjacent the drum by the vacuum, and a flexible dust barrier extending along at least a portion of the drum, the flexible dust barrier having a construction that is pervious to debris generated by the cutting component, the flexible dust barrier having an upper end located above the central axis and a free lower end that extends below the central axis.

8. The off-road excavation apparatus of claim 7, further comprising:

a shroud structure at least partially covering the cutting component, wherein the upper end of the flexible dust barrier is attached to the shroud structure such that the flexible dust barrier extends along a majority of a perimeter of the shroud structure.

* * * * *